United States Patent [19]

Fatula

[11] 3,961,736

[45] June 8, 1976

[54] RUBBER-COVERED SELF-CENTERING ROLLS

[75] Inventor: James J. Fatula, Perry Township, Lawrence County, Pa.

[73] Assignee: Ryman Engineering Co., Elwood City, Pa.

[22] Filed: May 9, 1975

[21] Appl. No.: 576,091

[52] U.S. Cl. ..... 226/192; 74/241; 198/202

[51] Int. Cl.[2] ..... B65H 17/20

[58] Field of Search ..... 220/192, 190, 191, 193; 198/202; 74/241; 29/121 R

[56] References Cited

UNITED STATES PATENTS

| | | | |
|---|---|---|---|
| 2,607,072 | 8/1952 | Johnson | 29/121 A |
| 2,772,879 | 12/1956 | Lorig | 226/192 |
| 2,869,866 | 1/1959 | Lorig | 226/192 |

*Primary Examiner*—Richard A. Schacher
*Attorney, Agent, or Firm*—Martin J. Carroll

[57] ABSTRACT

A self-centering roll includes a body, a first layer of rubber surrounding the body, and a second layer of rubber surrounding the first layer, the rubber on the first layer being softer and of lower density than the rubber in the second layer. Flexible projections are formed in the second layer of rubber on each side of the transverse center of the roll extending outwardly from the roll body toward the transverse center of the roll.

8 Claims, 1 Drawing Figure

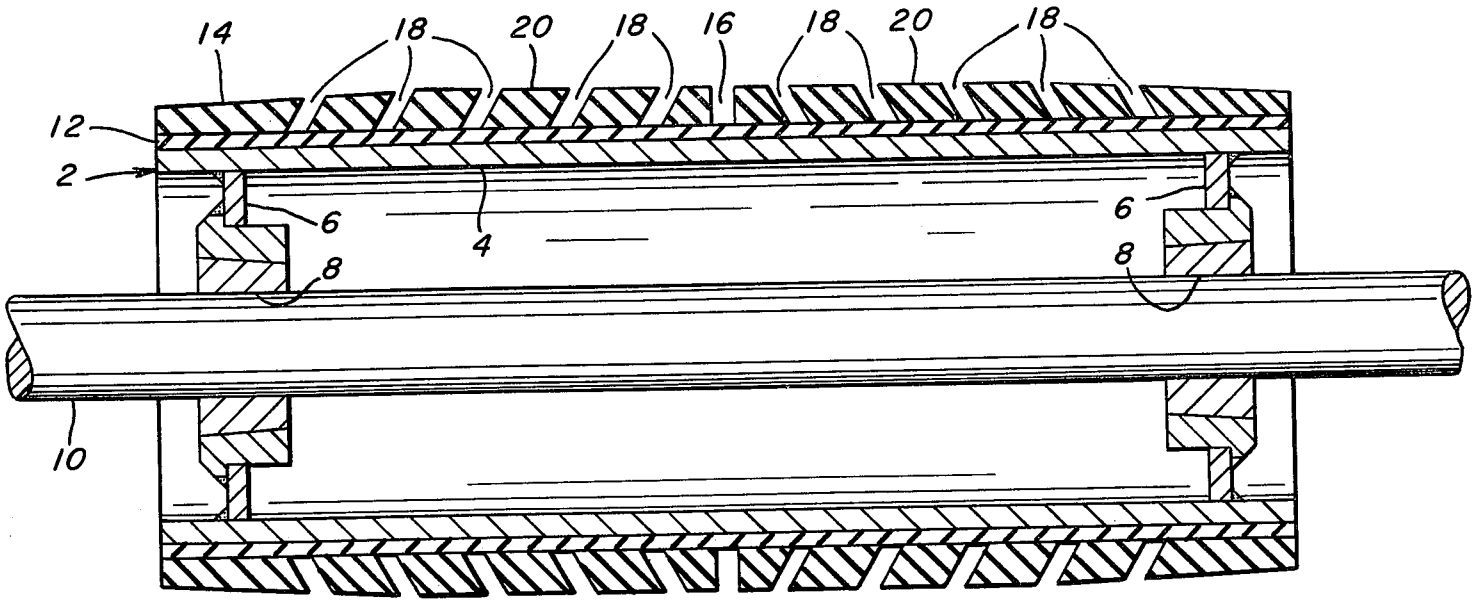
18
20
18
16
18
20
18
14
12
2
6
8
4
6
8
10

RUBBER-COVERED SELF-CENTERING ROLLS

This invention relates to self-centering rolls and more particularly to the type of rolls shown in Lorig, U.S. Pat. Nos. 2,592,581 dated 4-15-52 and 2,772,879 dated 12-4-56 and in Thornsbery U.S. Pat. No. 3,643,791 dated 2-22-72. The rolls shown in these patents include a roll body and flexible projections on each side of the transverse center of the roll extending outwardly toward the transverse center of the roll. In Lorig, U.S. Pat. No. 2,592,581, the projections are formed in a single layer of rubber surrounding the roll body by providing a plurality of spaced apart slots therein extending outwardly toward the transverse center of the roll. In Lorig, U.S. Pat. No. 2,772,879, the projections are formed in a single layer of rubber surrounding the roll body by providing a plurality of spaced apart slots therein extending outwardly toward the transverse center of the roll. In the Thornsbery patent the projections are formed in the single layer of rubber by providing a single continuous spiral slot or slit therein on each half of the roll. The patented rolls have been in successful commercial use for many years and continue to operate satisfactorily. However, since there is a single layer of rubber and since the rubber must be comparitively hard to hold up in service the centering effect is not sufficient in some cases where the tension of the belt or other material passing thereover is low.

It is therefore an object of my invention to provide a self-centering roll which will center better under light tensions or loads without affecting its working life.

This and other objects will be more apparent after referring to the following specification and attached drawing in which the single FIGURE is a longitudinal sectional view of the roll of my invention.

Referring more particularly to the drawing, reference numeral 2 indicates the roll body. While the roll body may be constructed in many ways that shown is simple and inexpensive. It consists of a tube 4 welded to a web 6 at each end. Each web 6 is provided with an opening 8 for receiving a shaft 10 which is preferably readily separable therefrom. A first layer of rubber 12 surrounds and is attached to the outside of tube 4. A second layer of rubber 14 surrounds and is attached to the first layer 12. The roll shown is of the type disclosed in Lorig, U.S. Pat. No. 2,592,581, but the construction so far described is equally suitable for the rolls of the other above-mentioned patents. A central peripheral slot 16 is provided in layer 14 and spaced apart slots 18 are provided in layer 14 on each side of the transverse slot 16 so as to provide flexible projections 20 similar to those of Lorig, U.S. Pat. No. 2,592,851. While it is preferred that the slots 18 terminate at the inner surface of the first layer 12, they may extend into layer 12 or terminate a short distance therefrom. The outside surface of the roll is shown as narrow-bodied; that is, the four projections on each side of center have the same outside diameter while the remaining projections are frusto-conical. However, the outer surface of the roll may be cylindrical or other shape depending upon its use.

The rubber in layer 12 must be softer and of less density than that in layer 14. The term rubber as used herein and in the claims, includes natural and synthetic rubbers and rubber-like materials. I have found that rubber of approximately 35 durometer is very suitable for use in layer 12 and rubber of approximately 65 durometer is very suitable for use in layer 14. Rubber of approximately 65 durometer is that commonly used with the patented rolls so that the wear is approximately the same.

The roll may be made in different ways. The layers 12 and 14 may be secured on the roll body and then machined in the usual way to provide the slots or slits. The layer 12 may be secured on the roll and the projections 20 separatly molded and then fastened to layer 12. When refinishing the rolls in some instances only the outer layer 14 need be replaced.

The rolls operate in much the same manner as the corresponding patented rolls. However, because the layer 12 is less dense and hence more resilient than layer 14 it depresses to a greater extent than if it were of the same rubber as layer 14. Thus, there is a greater centering action under the same load or tension than with rolls constructed as in the above mentioned patents. At the same time there is no decrease in life because the outer wearing surface is as hard as in previous rolls. In fact, it may be possible to make the outer layer of harded rubber than previously used.

While one embodiment of my invention has been shown and described it will be apparent that other adaptions and modifications may be made within the scope of the following claims.

I claim:

1. In a self-centering roll having a body and flexible projections on each side of the transverse center of the roll extending outwardly from the body toward said transverse center; the improvement comprising a first layer of rubber surrounding said body, and a second layer of rubber surrounding said first layer, the rubber in said first layer being softer and of lower density than the rubber in said second layer, said flexible projections being formed in said second layer.

2. The combination of claim 1 in which said flexible projections extend from the outside surface of said first layer to the outside surface of said second layer.

3. The combination of claim 1 in which said projections are spaced apart so as to form a slot therebetween.

4. The combination of claim 3 in which said flexible projections extend from the outside surface of said first layer to the outside surface of said second layer.

5. The combination of claim 1 in which the rubber in said first layer is approximately 35 durometer and the rubber in said second layer is approximately 65 durometer.

6. The combination of claim 5 in which said flexible projections extend from the outside surface of said first layer to the outside surface of said second layer.

7. The combination of claim 5 in which said projections are spaced apart so as to form a slot therebetween.

8. The combination of claim 7 in which said flexible projections extend from the outside surface of said first layer to the outside surface of said second layer.

* * * * *